US006383024B1

(12) United States Patent
Wang et al.

(10) Patent No.: US 6,383,024 B1
(45) Date of Patent: May 7, 2002

(54) VERTICALLY STACKED USB CONNECTOR

(75) Inventors: Sui Ya Wang; Guang Xing Shi, both of Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,361

(22) Filed: Feb. 28, 2001

(30) Foreign Application Priority Data

Oct. 20, 2000 (TW) ..... 89218234

(51) Int. Cl.[7] ..... H01R 13/648
(52) U.S. Cl. ..... 439/607
(58) Field of Search ..... 439/607, 608, 439/609, 541.5

(56) References Cited

U.S. PATENT DOCUMENTS 5,037,330 A * 8/1991 Fulponi et al. ..... 439/607
6,059,581 A * 5/2000 Wu ..... 439/79
6,074,218 A * 6/2000 Wu et al. ..... 439/63
6,099,351 A * 8/2000 Wu ..... 439/607
6,120,321 A * 9/2000 Wu ..... 439/541.5
6,139,367 A * 10/2000 Yeh ..... 439/609
6,155,872 A * 12/2000 Wu ..... 439/641.5
6,159,039 A * 12/2000 Wu ..... 439/541.5
6,162,089 A * 12/2000 Costello et al. ..... 439/541.5
6,165,014 A * 12/2000 Kao et al. ..... 439/607
6,174,198 B1 * 1/2001 Wu et al. ..... 439/541.5
6,186,830 B1 * 2/2001 Lin et al. ..... 439/607
6,224,422 B1 * 5/2001 Zhu et al. ..... 439/607
6,227,904 B1 * 5/2001 Wang et al. ..... 439/541.5
6,238,241 B1 * 5/2001 Zhu et al. ..... 439/541.5
6,238,244 B1 * 5/2001 Yang ..... 439/607

* cited by examiner

*Primary Examiner*—Tulsidas Patel
*Assistant Examiner*—Thanh-Tam Le
(74) *Attorney, Agent, or Firm*—Wei Te Chung

(57) ABSTRACT

A vertically stacked USB electrical connector (1) comprises a housing (2), a number of terminals (25), an upper inner shield (3), a lower inner shield (4), a front outer shield (51), and a rear outer shield (52). The lower inner shield forms a supporting pad (414) for abutting against a printed circuit board (7) on which the connector is mounted thereby ensuring the connector not to incline forwardly when a mated complementary connector is withdrawn from the connector. The front and rear outer shields enclose a base (21) of the housing while the inner shields enclose mating boards (23) projecting forwardly from the base. The outer shields are in electrical connection with the inner shields.

6 Claims, 3 Drawing Sheets

VERTICALLY STACKED USB CONNECTOR

BACKGROUND OF THE INVENTION

1. Field of the Invention

The present invention relates to an electrical connector, and particularly to a vertically stacked USB connector which is stable during withdrawal/insertion of a complementary connector from/into the connector.

2. Brief Description of the Related Art

Universal serial bus (USB) connectors have been arranged side-by-side to save precious input/output (I/O) port space. The side-by-side design is sometimes too wide to meet such a requirement. Therefore, a vertically stacked USB connector is developed to minimize the overall width occupied by the USB connector on a printed circuit board while having the advantage of multi-port connection. Such a vertically stacked USB connector faces two problems to resolve: a complete shielding of the vertically stacked USB connector and stability of the vertically stacked USB connector during mating/unmating with a complementary connector.

Hence, an improved vertically stacked USB connector is required to overcome the disadvantages of the prior art.

BRIEF SUMMARY OF THE INVENTION

A first object of the present invention is to provide a vertically stacked USB connector which has a shield capable of more adequately shielding the connector; and A second object of the present invention is to provide a vertically stacked USB connector which is stable to resist an insertion/withdrawal force of a complementary connector.

To achieve the above-mentioned object, a vertically stacked USB connector in accordance with the present invention includes a housing, a number of terminals secured to the housing, an upper inner shield, a lower inner shield, a front outer shield, and a rear outer shield.

The housing including a dielectric base and a pair of vertically aligned mating boards projecting forwardly from the base. Each inner shield has an enclosing section surrounding the mating boards, a pair of bent sections extending outwardly from the enclosing section, and a pair of flange for securing the inner shields to the base. The lower inner shield forms a supporting pad which abuts against a printed circuit board on which the connector is mounted, for ensuring the connector not to forwardly fall down. The front outer shield has a front wall and a pair of lateral edges extending laterally form the front wall and abutting the bent sections to establish electrical connection between the inner shields and the outer shield. The front wall defines a pair of apertures through which the enclosing sections of the inner shields pass. The rear outer shield engages with the front outer shield, cooperating with the inner shields, to entirely enclose the housing and the terminals for providing a complete shield to the USB connector.

Other objects, advantages and novel features of the present invention will become more apparent from the following detailed description of the present embodiment when taken in conjunction with the accompanying drawings.

DETAILED DESCRIPTION OF THE PREFERRED EMBODIMENT

Figure 1:
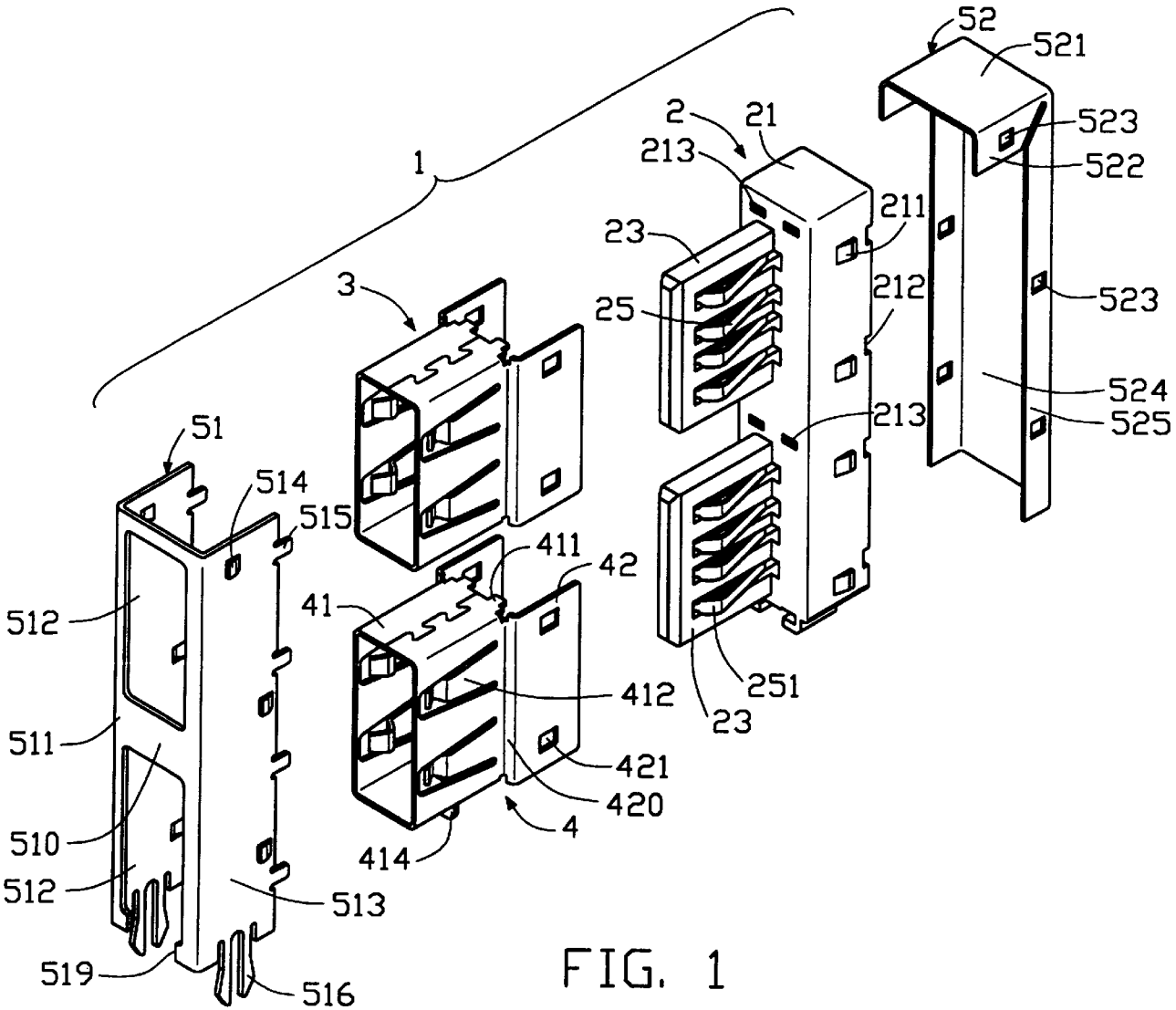
FIG. 1 is a perspective exploded view of a vertically stacked USB connector in accordance with the present invention, in which a plurality of terminals is mounted to a housing of the connector.

Referring to FIG. 1, a vertically stacked universal serial bus (USB) connector 1 of the present invention comprises a housing 2 with a plurality of terminals 25, an upper inner shield 3, a lower inner shield 4, a front outer shield 51, and a rear outer shield 52.

The housing 2 includes a rectangular dielectric base 21 and a pair of vertically aligned mating boards 23 projecting forwardly from the base 21. The base 21 forms a plurality of vertically aligned embosses 211 on each of two lateral sides thereof (only one side shown) and defines in a front surface thereof two slits 213 above each of the mating boards 23. The base 21 further defines a plurality of vertically aligned notches 212 along lateral rear edges thereof. The terminals 25 are secured in the base 21 with mating ends 251 thereof protrude from a same side of the mating boards 23 for engaging with corresponding contacts of a complementary connector (not shown).

Each inner shield 3, 4 comprises a rectangular enclosing section 41, a pair of bent sections 420 extending outwardly and rearwardly from lateral, rear edges of the enclosing section 41, and a pair of flanges 42 extending rearwardly respectively from the bent sections 420. Each enclosing section 41 forms a pair of tabs 411 extending rearwardly from an upper edge thereof and a plurality of tongues 412 stamped and formed inwardly from lateral sides thereof for clamping therebetween a shield (not shown) of the complementary connector. The enclosing section 41 of the lower inner shield 4 further forms a supporting pad 414 projecting vertically downwardly from a middle of a bottom side thereof. Each flange 42 defines a pair of windows 421 fittingly receiving two corresponding embosses 211.

The front outer shield 51 includes a front wall 510 and a pair of sidewalls 513 extending rearwardly from lateral edges 511 of the front wall 510. The front wall 510 defines upper and lower vertical aligned apertures 512 separated by a divider (not labeled) therebetween. The lower aperture 512 is opened to a bottom of the front wall 510 for extension of the supporting pad 414 of the lower inner shield 4 when the constituted components of the connector 1 are assembled together. A pair of projections 519 extends inwardly from bottoms of the edges 511 into the lower aperture 512. Each sidewall 513 forms a boardlock 516 extending downwardly froma bottom edge of the sidewall 513 for extension through a printed circuit board (PCB) 7 (see FIG. 3) to have a secure engagement therewith, a plurality of stubs 515 extending rearwardly from a rear edge of the sidewall 513, and three nubs 514 arranged along an upper edge and the rear edge of the sidewall 513.

The rear outer shield 52 cooperates with the front outer shield 51 to provide a complete outer shielding to the USB connector 1. The rear outer shield 52 has an upper wall 521 and a rear wall 524 depending from a rear edge of the upper wall 521. Both the upper wall 521 and the rear wall 524 have laces 522, 525 at lateral edges thereof, in which the laces 522 of the upper wall 521 are extended downwardly and the laces 525 of the rear wall 524 are extended forwardly. The laces 522, 525 define holes 523 corresponding to the nubs 514.

Figure 2:
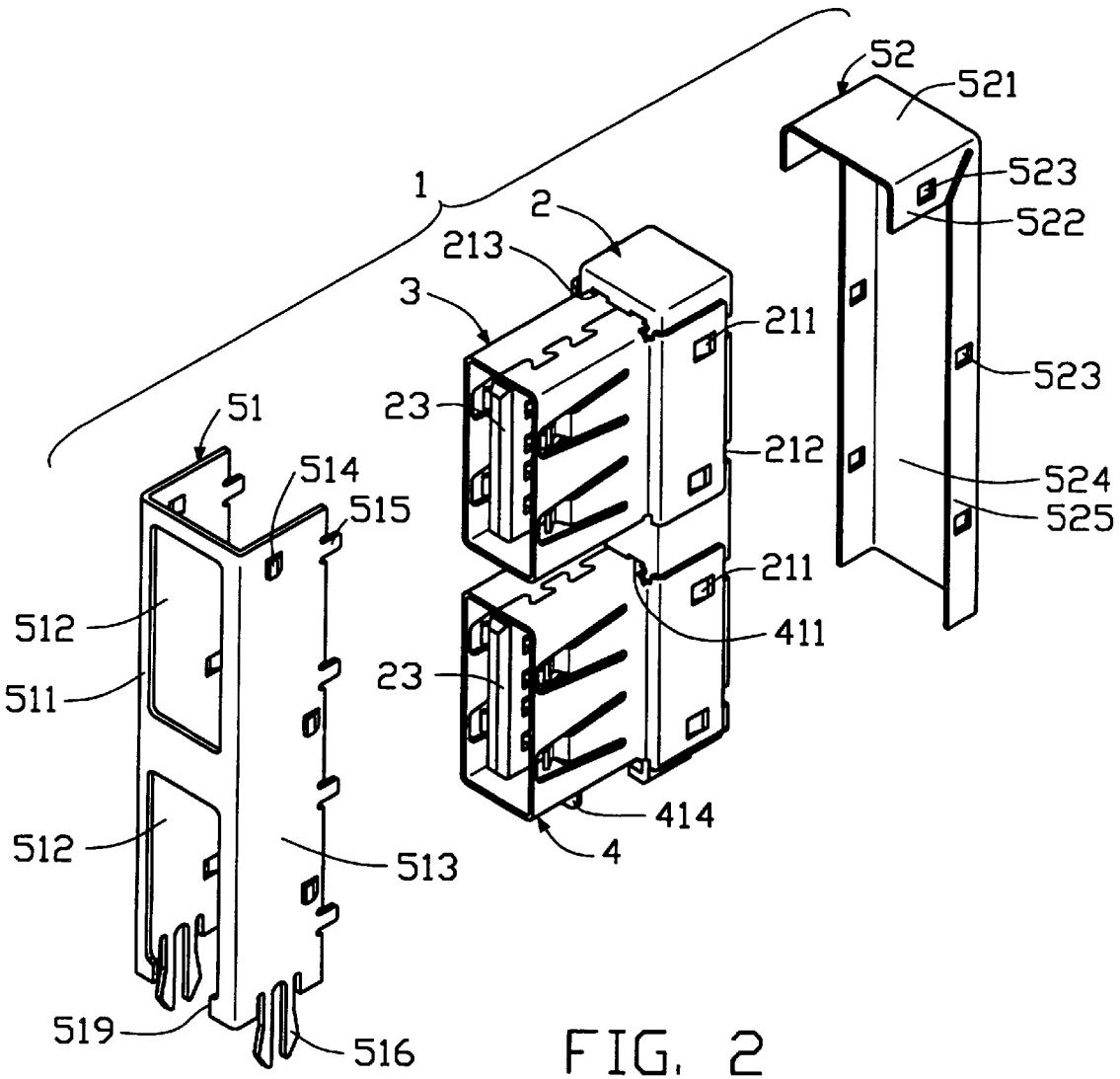
FIG. 2 is a partially assembled view of the vertically stacked USB connector of FIG. 1.
Figure 3:
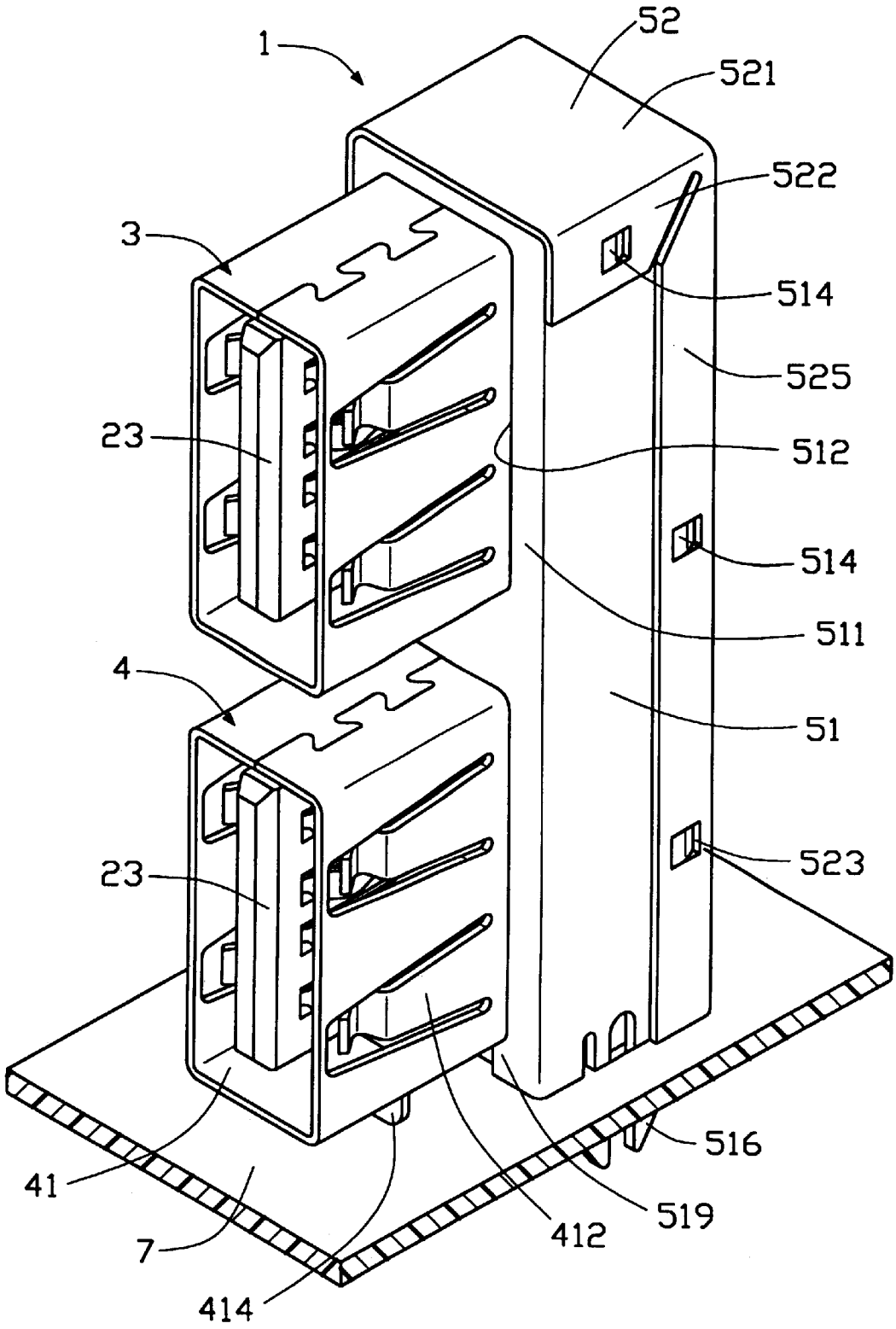
FIG. 3 is an assembled view of the vertically stacked USB connector of FIG. 1, showing the vertically stacked USB connector mounted on a printed circuit board.

Referring to FIGS. 2 and 3, the upper and lower inner shields 3, 4 are locked to the housing 2. The embosses 211 of the base 21 fit through corresponding windows 421 of the flanges 42 of the inner shields 3, 4 to engage with the flanges 42, while the tabs 411 of the inner shields 3, 4 extend into corresponding slits 213 of the base 21. The enclosing sections 41 of the inner shields 3, 4 thus surround the terminals 25 secured on the mating boards 23. The bent sections 420 abut against lateral front edges of the base 21. The front outer shield 51 is mounted to the housing 2 in a manner that the enclosing sections 41 extend through corresponding apertures 512 of the front outer shield 51 while the supporting pad 414 passes through between the projections 519 to reach a position in front of the front wall 510 of the front outer shield 51. Both edges 511 abut against the bent sections 420 of the inner shields 3, 4 to acquire an electrical connection therebetween. The sidewalls 513 embrace the flanges 42 of the inner shields 3, 4 and the base 21. The stubs 515 project beyond a rear face of the base 21 and are then curved into corresponding notches 212, whereby the front outer shield 51 is secured to the base 21 and the inner shields 314. Finally, the rear outer shield 52 is latched to the front outer shield 51 by fitting the nubs 514 of the front outer shield 51 through corresponding holes 523 of the rear outer shield 52. The nubs 514 engage with the rear outer shield 52 to provide an electrical and mechanical connection between the front outer shield 51 and the rear outer shield 52. The inner shields 3, 4 cooperate with the outer shield 51, 52 to entirely enclose the housing 2 and the terminals 25, thereby providing a complete shielding to the vertically stacked USB connector 1. Accordingly, the vertically stacked USB connector 1 in accordance with the present invention can effectively prevent signal flowing therethrough from electromagnetic interference (EMI).

Referring particularly to FIG. 3, the USB connector 1 is mounted on the PCB 7. The boardlocks 516 extend through the PCB and have a secure engagement therewith. The supporting pad 414 presses against the PCB 7. The supporting pad 414 can resist moment acting on the USB connector 1 when the complementary connector is withdrawn from the USB connector 1, thereby preventing the USB connector 1 from inclining forwardly. Therefore, the vertically stacked USB connector 1 can be stably and reliably mounted on the PCB 7 during the use of the USB connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fall extent indicated by the broad general meaning of the terms in which the appended claims are expressed.

What is claimed is:

1. A combination of a connector and a printed circuit board, comprising:

a housing including a dielectric base and at least two vertically aligned mating boards projecting forwardly from the base;

a plurality of terminals secured to the housing, each terminal having a mating end protruding from a corresponding mating board for mating with a contact of a complementary connector;

an upper inner shield and a lower inner shield mounted to the housing, each inner shield having an enclosing section surrounding the mating ends of corresponding terminals, at least a bent section extending outwardly and rearwardly from a corresponding lateral edge of the enclosing section, and at least a flange extending rearwardly from the bent section, the flange being retained to the base; and an outer shield including a front wall and a pair of sidewalls extending rearwardly from the front wall, the front wall defining an upper and a lower vertically aligned apertures for extension of the enclosing sections of the inner shields and the mating boards, respectively, the sidewalls forming a pair of boardlocks extending through the printed circuit board;

wherein the front wall having at least a lateral edge abutting against the bent section of the inner shields to achieve an electrical connection therebetween.

2. The combination as claimed in claim 1, wherein the outer shield comprises a front outer shield and a rear outer shield which are engaged with each other to enclose the base.

3. The combination as claimed in claim 2, wherein the front outer shield forms first securing means for mounting the front outer shield to the base and second securing means for engaging with the rear outer shield.

4. The combination as claimed in claim 3, wherein the first securing means and the second securing means are both located on the sidewalls.

5. The combination as claimed in claim 1, wherein the lower aperture extends through a bottom edge of the front wall.

6. The combination as claimed in claim 1, the lower inner shield forms a supporting pad depending from the enclosing section of said lower inner shield, the supporting pad pressing against the printed circuit board.

* * * * *